US006332017B1

(12) United States Patent
Carroll et al.

(10) Patent No.: US 6,332,017 B1
(45) Date of Patent: Dec. 18, 2001

(54) SYSTEM AND METHOD FOR PRODUCING PULSED MONOCHROMATIC X-RAYS

(75) Inventors: Frank E. Carroll; Robert H. Traeger; Marcus H. Mendenhall; James W. Waters; Glenn Edwards; Charles A. Brau, all of Nashville, TN (US)

(73) Assignee: Vanderbilt University, Nashville, TN (US)

( * ) Notice: Subject to any disclaimer, the term of this patent is extended or adjusted under 35 U.S.C. 154(b) by 0 days.

(21) Appl. No.: 09/488,898

(22) Filed: Jan. 21, 2000

(51) Int. Cl.[7] ..... H01J 35/14
(52) U.S. Cl. ..... 378/119; 378/138
(58) Field of Search ..... 378/119, 121, 378/138, 137

(56) References Cited

U.S. PATENT DOCUMENTS

| | | | |
|---|---|---|---|
| 3,576,997 | 5/1971 | Slavin | 378/137 |
| 3,772,522 | 11/1973 | Hammond et al. | 250/503 |
| 3,777,156 | 12/1973 | Hammond et al. | 250/280 |
| 4,010,370 | 3/1977 | LeMay | 250/366 |
| 4,037,920 | 7/1977 | Runciman et al. | 350/7 |
| 4,082,416 | 4/1978 | Runciman et al. | 350/6.8 |
| 4,082,417 | 4/1978 | Runciman et al. | 350/6.8 |
| 4,118,099 | 10/1978 | Weiss et al. | 350/3.73 |
| 4,132,654 | 1/1979 | Braun | 250/320 |
| 4,144,457 | 3/1979 | Albert | 250/445 |
| 4,149,076 | 4/1979 | Albert | 250/402 |
| 4,179,100 | 12/1979 | Sashin et al. | 250/416 |
| 4,203,034 | 5/1980 | Carroll, Jr. | 250/280 |
| 4,210,810 | 7/1980 | Berry et al. | 250/347 |
| 4,298,800 | 11/1981 | Goldman | 250/445 |
| 4,311,389 | 1/1982 | Fay et al. | 356/354 |
| 4,342,914 | 8/1982 | Bjorkholm | 378/99 |
| 4,441,809 | 4/1984 | Dudley et al. | 356/1 |
| 4,598,415 | 7/1986 | Luccio et al. | 378/119 |
| 4,599,741 | 7/1986 | Wittry | 378/85 |
| 4,809,309 | 2/1989 | Beekmans | 379/99 |

(List continued on next page.)

OTHER PUBLICATIONS

Amirmadhi, F., et al., "Electron bunch length measurements at the Vanderbilt FEL", (1996), *Nuclear Instruments and Methods in Physics Research,* A375:95–96.

Amirmadhi, F., et al., "New autocorrelation technique for the IR FEL optical pulsewidth measurements", (1996), *Nuclear Instruments and Methods in Physics Research,* A375:427–429.

Brau, C.A., et al., "Medical and materials research at the Vanderbilt University Free–Electron Laser Center", (1994), *Nuclear Instruments and Methods in Physics Research,* A341:ABS 21—ABS 22/ North Holland.

(List continued on next page.)

*Primary Examiner*—Robert H. Kim
*Assistant Examiner*—Irakli Kiknadze
(74) *Attorney, Agent, or Firm*—Cooley Godward, LLP

(57) ABSTRACT

A system for generating tunable pulsed monochromatic X-rays comprises a tabletop terawatt laser delivering 10 Joules of energy in 10 ps at a wavelength of 1.1 microns. The light beam from the laser is counter-propagated against an electron beam produced by a linear accelerator. X-ray photons are generated by inverse Compton scattering that occurs as a consequence of the "collision" that occurs between the electron beam and IR photons generated by the laser.

The system uses a novel pulse structure comprising, in a preferred embodiment, a single micropulse. The LINAC is configured to generate an electron beam having 1 nanocoulomb of charge in a microbunch having a pulse length of about 5 picoseconds or less (or an electron beam brightness of $10^{12}$ A/m$^2$–radian$^2$@ 500 A). A beam alignment subsystem is used at the laser beam—electron beam interaction zone and directs the X-ray beam, in a preferred embodiment, through a beryllium window and onto mosaic crystals which divert the beam into a beam transport system toward the imaging target.

28 Claims, 6 Drawing Sheets

U.S. PATENT DOCUMENTS

| | | | | |
|---|---|---|---|---|
| 4,953,188 | | 8/1990 | Siegel et al. | 378/43 |
| 4,958,363 | | 9/1990 | Nelson et al. | 378/85 |
| 4,975,917 | | 12/1990 | Villa | 372/5 |
| 5,011,245 | | 4/1991 | Gibbs | 350/6.5 |
| 5,125,019 | | 6/1992 | Evain et al. | 378/137 |
| 5,132,997 | | 7/1992 | Kojima et al. | 378/85 |
| 5,138,642 | | 8/1992 | McCroskey et al. | 378/19 |
| 5,227,733 | | 7/1993 | Yamada | 328/234 |
| 5,245,648 | | 9/1993 | Kinney et al. | 378/43 |
| 5,247,562 | | 9/1993 | Steinbach | 378/119 |
| 5,263,073 | | 11/1993 | Feldman | 378/34 |
| 5,268,951 | | 12/1993 | Flamholz et al. | 378/34 |
| 5,268,954 | | 12/1993 | Middleton | 378/85 |
| 5,315,375 | | 5/1994 | Allen | 356/417 |
| 5,353,291 | | 10/1994 | Sprangle et al. | 372/5 |
| 5,479,017 | | 12/1995 | Yamada et al. | 250/336.1 |
| 5,495,515 | | 2/1996 | Imasaki | 250/336.1 |
| 5,509,043 | | 4/1996 | Van Der Sluis | 378/85 |
| 5,541,944 | | 7/1996 | Neil | 372/2 |
| 5,602,894 | | 2/1997 | Bardash | 378/87 |
| 5,604,782 | | 2/1997 | Cash, Jr. | 378/85 |
| 5,628,314 | | 5/1997 | Kumagai | 128/653.1 |
| 5,781,606 | | 7/1998 | Dobbs et al. | 378/19 |
| 5,805,620 | | 9/1998 | Liu et al. | 372/2 |
| 5,815,517 | | 9/1998 | Ikegami | 372/2 |
| 5,825,847 | | 10/1998 | Ruth et al. | 378/119 |
| 5,930,331 | * | 7/1999 | Rentzepis et al. | 378/136 |
| 6,035,015 | * | 3/2000 | Ruth et al. | 378/119 |
| 6,226,354 | * | 5/2000 | Mamine | 378/119 |

OTHER PUBLICATIONS

Brau, C.A., et al., "The Vanderbilt University Free–Electron Laser Center", (1993) *Nuclear Instruments and Methods in Physics Research,* A341:ABS 21—ABS 22/ North Holland.

Brau, C.A., et al., "The Vanderbilt University Free–Electron Laser Center", (1993) *Nuclear Instruments and Methods in Physics Research,* A319:47–50.

Burke, D. L., et al., "Positron Production in Multiphoton Ligh–by–Light Scattering", (1997), *Physical Review Letters,* 79:9:1626–1629.

Carroll, F., et al., "Attenuation of Monochromatic X–Rays by Normal and Abnormal Breast Tissues", (1994), *Investigative Radiology,* 29:3:266–272.

Carroll, F., et al., "Production of tunable, monochromatic X–Rays by the Vanderbilt free–electron laser", (1999), *SPIE,* 3614:139–146.

Carroll, F., et al., "Near–Monochromatic X–Ray Beams produced by the Free Electron Laser and Compton Backscatter", (1990), *Investigative Radiology,* 25:5:465–174.

Dong, W., et al., "Current Status of the VU MFEL Compton X–Ray Program", (1994), *J. of X–Ray Science and Technology,* 4:346–352.

Fitzgerald, R., "Phase–Sensitive X–Ray Imaging", (2000), *Physics Today,* 23–26.

Gordon, C., et al., "Time–gated imaging with an ultrashort –pulse, laser–produced–plasma x–ray source", (1995), *Optics Letters,* 20:9:1056–1058.

Johns, P., et al., "X–ray characterization of normal and neoplastic breast tissues", (1987), *Phys. Med. Bio.,* 32:6:675–695.

Madey, J., "Stimulated Emission of Bremsstrahlung in a Periodic Magnetic Field", (1971), *J. Applied Physics,* 42:5:1906–1913.

Mendenhall, M., et al., "A detector for low–energy (few hundred eV–20 keV) x–rays in the presence of a high background of high–energy X–rays", (1998), *Nuclear Instruments and Methods in Physics Research,* A437:432–438.

Sparks, C., "Mosaic Crystals for Obtaining Larger Energy Bands and high Intensities from Synchrotron Radiation Sources", (1978), Workshop on X–Ray Instrumentation for Synchrotron Radiation Sources, (1978), Workshop on X–Ray Instrumentation for Synchrotron Radiation Research/Stanford Linear Accelerator Center/Apr. 3–5, 1978, III35–III46.

Takeda, T., et al., "Phase–Contrast Imaging with Synchrotron X–Rays for Detecting cancer lesions. Preliminary Investigation.", (1995), *Acad Radiol,* 2:799–803.

Tompkins, P., "Application of Graphite Mosaic Monochromator Crystals for X–Ray Transport", (1994), *J X–Ray Science and Technology,* 4:301–311.

* cited by examiner

SYSTEM AND METHOD FOR PRODUCING PULSED MONOCHROMATIC X-RAYS

This application is based on, and Applicant claims benefit of, U.S. Provisional Patent Application Ser. No. 60/117,114, filed Jan. 25, 1999, for a "System for Producing Pulsed Monochromatic X-rays."

This invention was made with government support under grant N00014-94-1-1023 awarded by Office of Naval Research. The government has certain rights in the invention.

BACKGROUND OF THE INVENTION

This invention relates to systems and methods for generating pulsed, tunable, monochromatic X-rays. More particularly, this invention pertains to systems for generating pulsed, tunable, monochromatic X-rays with high flux and in a configuration useful both for medical imaging and therapeutics and as a research instrument in the biological, biomedical, and materials sciences.

The characteristics of some X-ray beams are potentially such that they can be used in standard geometry monochromatic imaging, CT-like images of the breast using a rotating mosaic crystal "optic", time-of-flight imaging and phase contrast images. However, X-ray absorption imaging as currently practiced utilizes only a small part of the information amassed by an X-ray beam traversing a patient. For example, assessing damage to limbs and body cavities in severe trauma by appraising the disruption of fascial planes, and visualizing devitalized tissues, extravasated blood or imbedded non-opaque foreign materials is very difficult or sometimes impossible with standard X-rays or computerized tomography (CT). The same is true when one wishes to evaluate the patency of arteries and veins, non-invasively and without the use of dangerous contrast agents. Potentially, a great deal more information could be extracted during an examination, if a more versatile monochromatic X-ray beam/detector combination were available for use. Similarly, the early detection of abnormalities such as tumors, fatty replacement, or scarring in other organs such as the breast or lung is problematic at best using conventional imaging techniques and equipment.

Currently, standard X-ray tubes deliver a much broader spectrum of radiation than what is either needed or desired to make an image. Pulsed, tunable monochromatic X-rays would allow one to select a photon energy best suited to the imaging task at hand. For example, the frequency that would be optimal to image a breast is very different from the frequency needed to image a chest or the brain.

Monochromatic X-ray imaging can simultaneously reduce the radiation dose to a patient and reduce scattered radiation from high energy photons not needed for the image in the first place. This can be useful in several ways. Cancerous breast tissues, for example, exhibit higher linear attenuation characteristics than do normal tissues, when studied with monochromatic X-rays. This property can be exploited to improve the sensitivity and specificity of breast imaging in a number of ways. The ability to alter the geometry of an X-ray beam would make it ideal for imaging in humans as well as in materials science, molecular biology and cell biology. Standard geometry monochromatic imaging, CT imaging using new X-ray optics made from mosaic crystals, phase contrast imaging, and time-of-flight imaging are just a few examples of the potential applications for such a system.

Conventional medical X-ray equipment has not employed short pulse structures in X-ray generation. Consequently, conventional X-ray equipment continues to generate unneeded background radiation, requiring the use of shielding that substantially increases the size of the equipment. Although pulsed soft X-rays have been used in photolithography for manufacturing of integrated circuits, there has been no similar use in imaging applications or in the production of hard X-rays.

Production of pulsed, nearly monochromatic X-rays via the inverse Compton effect (in which optical photons and electrons interact to provide X-ray photons, as demonstrated in FIG. 2 and discussed in more detail below) has been recognized for some time. Systems employing this methodology are theoretically capable of providing a steady supply of ultra-short (e.g., less than 10 picoseconds), X-ray pulse strings. However, such systems exhibit a variety of shortcomings. For example, they typically require large, expensive laser sources to produce the optical photons. Additionally, the systems are unable to adequately control the production of the X-ray pulses, so that appreciable shielding is still required, and any failure of the shielding mechanism may result in a dangerous dose of radiation to a patient. Moreover, the systems are incapable of reducing or eliminating the adverse effects of patient movement during the imaging process. In short, such systems are impractical for wide-spread, convenient use, particularly for the production of high quality, safe X-ray images.

In addition to medical imaging, a source of an intense, pulsed (<10 ps) hard X-rays will be of value in time-resolved structure determination in both materials science and structural biology.

What is needed, then, is a compact source of pulsed, tunable, monochromatic X-rays having the proper beam geometry, low radiation dose, and high brightness to image human beings and other materials.

SUMMARY OF THE INVENTION

The problems of prior art X-ray imaging equipment and methods are solved in the present invention of a pulsed monochromatic X-ray system. The X-ray system of the invention is an integrated unit comprised of a conventional tabletop terawatt laser delivering 10 Joules of energy in 10 ps at a wavelength of 1.1 microns. The output IR light beam from the laser is counter-propagated against an electron beam produced by a linear accelerator ("LINAC") with a photocathode injector and small RF accelerator and gun. X-ray photons are generated by inverse Compton scattering that occurs as a consequence of the "collision" that occurs between the electron beam and IR photons generated by the laser.

The system uses a novel pulse structure comprising, in a preferred embodiment, a single micropulse. The electron beam from an RF electron LINAC comes in bunches spaced at the RF frequency or some sub-harmonic thereof. These bunches are called microbunches. The light produced by a microbunch (and sometimes the microbunch itself) is called a micropulse. The LINAC is configured to generate an electron beam having 1 nanocoulomb of charge in a microbunch having a pulse length of about 10 picoseconds or less (or an electron beam brightness of $10^{12}$ $A/m^{2-}{}_{radian}{}^{2}$@ 500 A). Operating the system in such a single pulse "microbunch" mode will reduce the need for shielding so that the system can be operated in an environment that is outside of a standard accelerator vault. Accordingly, the system is fabricated in such a way as to fit into a standard sized X-ray room.

A beam alignment sub-system is used at the IR—electron beam interaction zone and directs the X-ray beam, in a preferred embodiment, through a beryllium window and onto mosaic crystals which divert the beam into a beam transport system toward the imaging target.

The reduction in the amount of shielding required by the system facilitates a configuration in which the X-ray beam deflects off of the mosaic crystals at shallow angles, allowing production and delivery of hard X-rays in the 10–50 keV range at high flux (for example, $1.0\times10^{10}$ photons/pulse). These can be delivered into several adjacent patient examining rooms for use in mammography, plain films of extremities and spine, chest X-rays, abdominal films, CT of all body parts using mosaic crystal rotators, and for angiography and myelography. In addition, the system can be used for time-of flight ("TOF") imaging, phase contrast imaging and weighted sums analysis of tissues, and in radiotherapy and chemoradiotherapy by tuning to K-edges.

A novel feature of the present invention is that the user can obtain an image of human tissue in one shot having a duration of 2–10 ps. Also, because the system operates in the microbunch mode, its physical size is substantially reduced as compared to prior art systems. The reduced background radiation generated by the accelerator makes the system usable in a conventional hospital treatment area or research lab. The system is also inherently safer when running in the microbunch mode in the event of a micropulse of electrons getting out of control due to a system failure. The radiation that a patient would receive, if it were possible for them to receive the radiation from the entire electron bunch, would be about 0.4 to 4 Rads, delivered to a very small area. The short pulse duration also eliminates the effects of movement by or within the subject during the imaging process.

In high flux applications, the beams can be split, up to ten times for example, allowing for ten views to be obtained simultaneously in a one-shot CT of 2–10 ps.

Because the system is tunable, an X-ray wavelength can be selected that is most suited to a specific imaging task. For example, the optimal wavelength for imaging a breast is quite different from the optimal wavelengths for imaging the chest or brain. In addition, the X-rays generated by this system are inherently of narrow bandwidth as opposed to the relatively continuous, broad spectrum X-rays produced by conventional X-ray tubes. The narrow bandwidth and tunability improve tissue discrimination and allow for improvements in contrast resolution, spatial resolution, and temporal resolution for all procedures.

The system of this invention produces a small effective focal spot size. Consequently, the X-rays can be used in phase contrast imaging, which delivers 100 to 1000 times more information than is available from conventional absorption imaging. The beam geometry of this system also allows for the study of large body parts.

The system can be used with conventional X-ray detectors, such as film, charge coupled devices, and time-of-flight detectors, or with special detectors optimized for use with the characteristics of the X-ray beam and application.

The system can operate in a variety of modes, including:

Plain films, computed radiography, and direct digital radiography to obtain chest radiographs, mammograms, extremity films, spine films, and abdominal films;

Contrast enhanced studies, with K-edge imaging being feasible in both standard angiographic format and with CT techniques, thereby reducing the radiation dose to the patient and while decreasing contrast medium load;

CT and microtomography, where computed tomography yielding 3-D reconstructions of anatomy anywhere in the body, perhaps followed by microtomography of identified lesions;

Weighted sums analysis, where a lesion detected by the system can be analyzed in vivo using a weighted sums analysis of the differential absorption of an area relative to other tissues or to expected norms for that tissue, during multiple exposures made while incrementally changing the beam energy;

Time of flight (TOF) imaging, performed in 2 ps using the monochromatic X-rays generated by this system, and eliminating scatter so that the dose may be reduced as compared to using monochromatic beams without TOF techniques; and Phase contrast imaging, for determining the specific gravity of tissues, detecting infection, tumors and traumatic disruption of tissue planes, and study of blood flow without use of contrast agents.

DETAILED DESCRIPTION OF THE PREFERRED EMBODIMENTS

Figure 1:
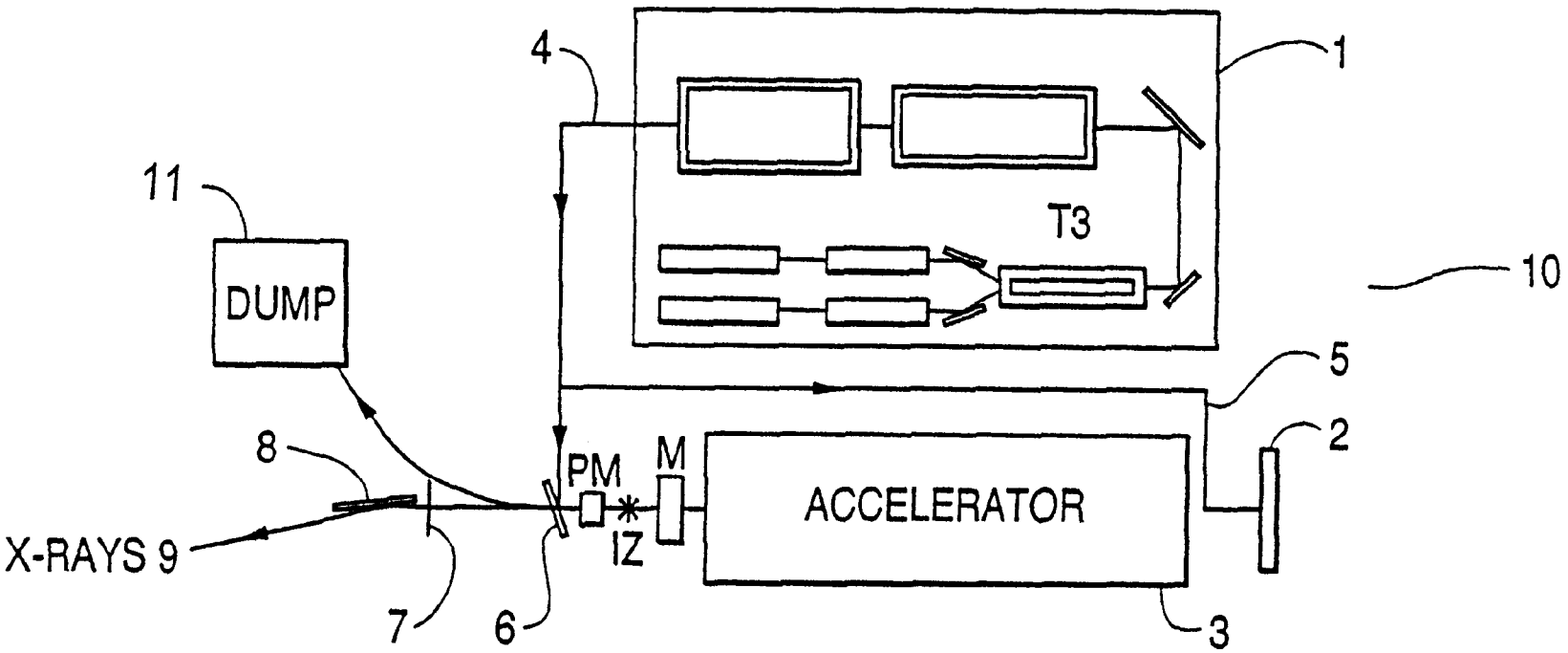
FIG. 1 is a schematic diagram of one embodiment of the X-ray system of the present invention.

The arrangement of components used in one embodiment of the system 10 is schematically illustrated in FIG. 1. A pulsed electron beam is generated by a conventional photocathode 2 and linear accelerator 3 and focused to a beam diameter of 50–200 microns using a focusing magnet M. The electron beam is then directed through an electron beam transport line into a small evacuated beam pipe containing a beam interaction zone IZ. A pulsed infrared (IR) beam 4 is simultaneously generated by a conventional tabletop laser 1 and directed into a vacuum chamber containing a beryllium mirror 6. The mirror 6 is oriented to target the IR beam directly toward the opposing electron beam so that they collide at the IZ. As the electrons collide with the IR photons, the IR photons are converted to a beam 9 of X-ray photons and leave the IZ on a path that is almost collinear with the electron beam path.

In a preferred embodiment of the system 10, the X-ray photons generated by the system 10 first pass through a beryllium window 7 to provide a transition from the evacuated beam pipe to ambient air. The X-ray beam is then directed at an array of graphite mosaic crystals 8. The X-rays will deflect off of the crystals 8 at relatively shallow angles into a beam transport pipe, for delivery into one or more patient examining or imaging rooms (not shown). The residual portion of the electron beam is carried out of the IZ and deflected by a permanent magnet PM into a conventional electron dump 11. Because of the novel pulse structure and operational parameters of this system 10, the dump 11 will have to dissipate very little power, on the order of 0.5 watts. Accordingly, the dump 11 can be a simple conductive block, a 4" copper cube for example, with no auxiliary cooling needed.

Figure 3:
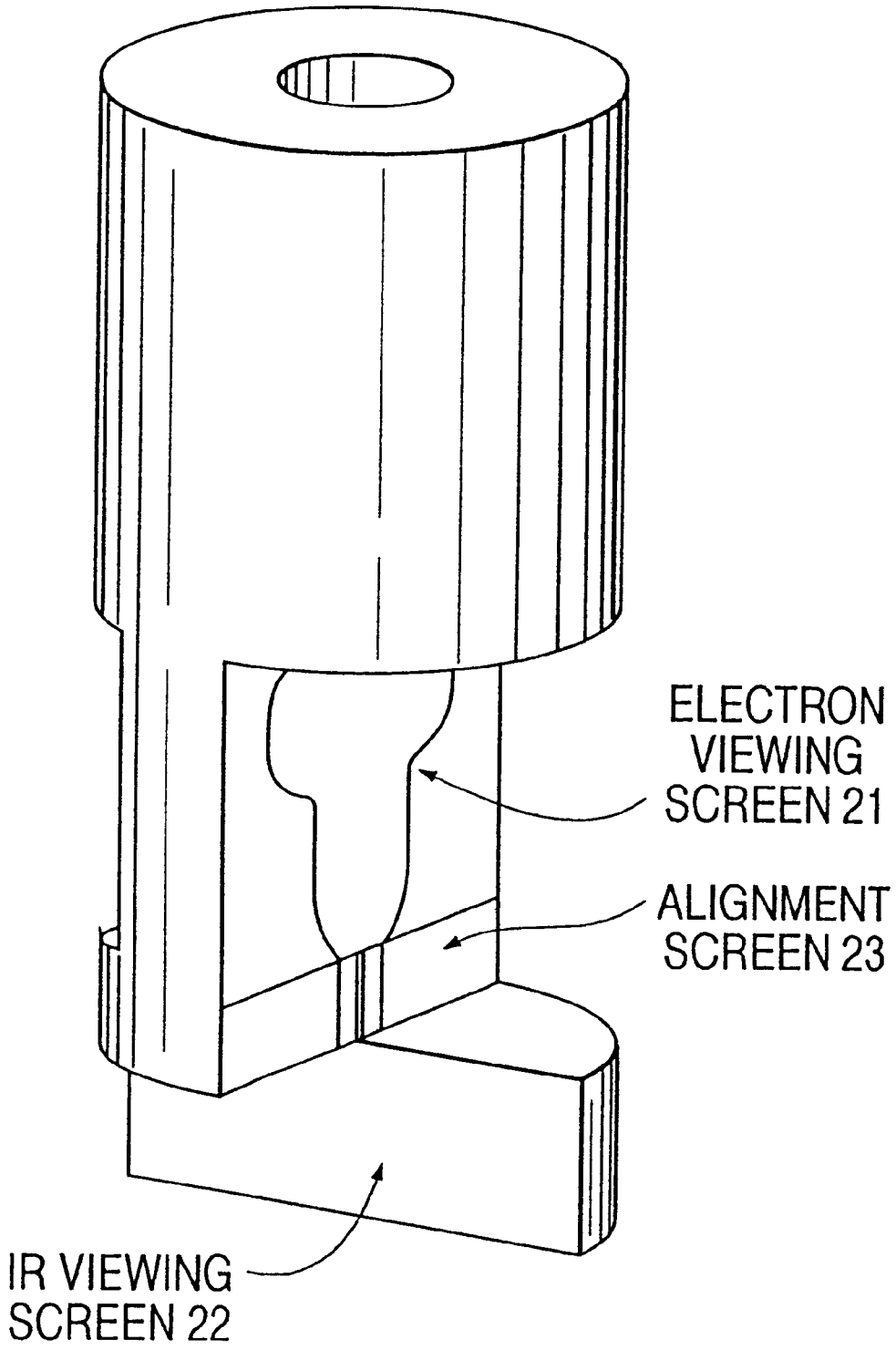
FIG. 3 is a perspective view of a beam alignment tool used in the X-ray system of this invention to align the electron and IR beams in the interaction zone during system setup and calibration.

Preferably, the diameters of the colliding IR and electron beams will be substantially equal and as small as possible, to maximize the efficiency of production of X-ray photons using inverse Comptom scattering. In this regard, it is important that the opposing IR and electron beams be carefully aligned so that they impinge directly on each other, preferably producing a beam spot size at the collision point in the IZ of 25–100 microns in diameter. Accordingly, the system 10 includes a beam alignment tool that is mechanically inserted into the IZ during initial setup of the system 10 and during periodic calibration. An example of such a beam alignment tool 20 is shown in FIG. 3, combining an electron beam viewing screen 21, an IR viewing screen 22, and an alignment screen 23. The beams are brought into co-alignment, first by visualization of the transition radiation produced by the electron beam hitting a beryllium electron beam viewing screen 21 and secondly by focusing the IR beam onto an aluminum IR viewing screen 22. The electron beam and IR screens 21, 22 are machined from a single aluminum plug, so that their surfaces are at 90°0 to one another and centered to the electron beam using actuators in the X, Y and Z directions. Both beams are observed through a common window.

Both the electron beam and IR laser source 1 are pulsed. Preferably, the IR and electron beam pulses are closely synchronized to maximize efficiency and minimize background radiation. To obtain such synchronization and accurate timing of beam arrival at the IZ, a small amount of the IR beam from the laser 1 can be diverted at 5 and directed at the photocathode 2, thus triggering the electron emission pulse simultaneously with the IR pulse generated from the laser 1. Generally, the laser source 1 should be capable of generating a 3–10 ps pulse having an energy of 1 to 10 Joules, with a repetition rate of 1 Hz to 10 Hz and a spectral width of <0.5%. Such a laser may be commercially available as an Alexandrite short pulse oscillator from Light Age, Inc., of Somerset, N.J., or, with lower repetition rates, a Nd:glass laser from Positive Light of San Jose, Calif.

The electron beam source 2, 3 is adjusted to deliver one nanocoulomb of charge in a single microbunch micropulse having a pulse length of 10 picoseconds or less (or an electron beam brightness of $10^{12}$ A/m$^2$–radian$^2$ @ 500 A). Again, the electron beam pulse should be specified to correspond in time and duration to the IR beam pulse. An RF LINAC could be used as the electron beam source. The LINAC should be capable of supplying a beam energy in the range of 25 MeV to 50 MeV, and a pulse charge of greater than one nanocoulomb at a pulse length of less than 10 ps. The emittance of the LINAC should be <3 mm-mrad (rms), with a spot size diameter of 25 microns to 100 microns (90%), and a pointing stability that is small compared to the spot size. Accelerators capable of meeting these requirements are available from Advanced Energy Systems, Inc. of Medford, N.Y., as well as from other sources.

Figure 4:
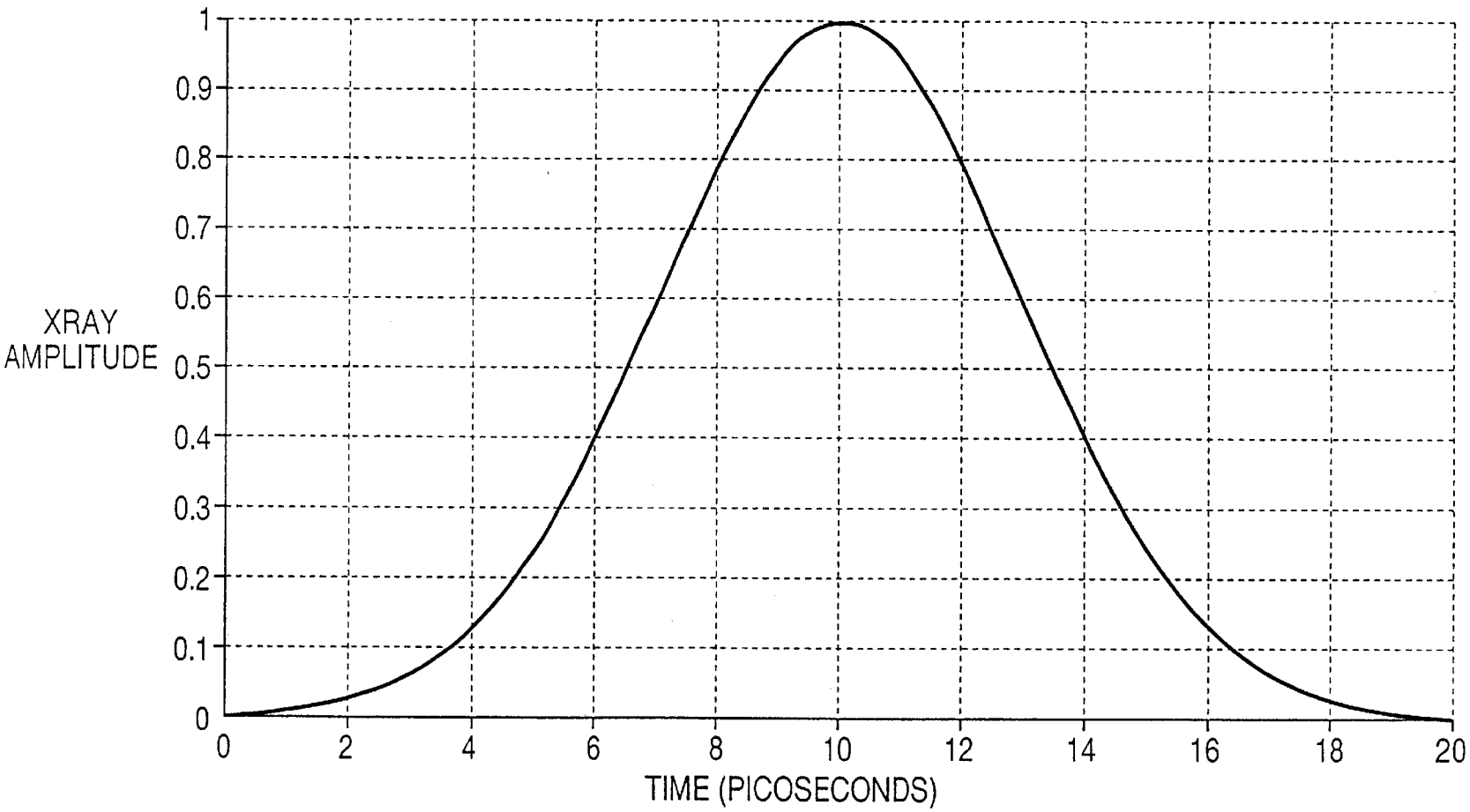
FIG. 4 is graphical representation, in the time domain, of an X-ray pulse generated by the system of this invention.

Using the system 10 as described, short pulses (1–10 ps) of hard X-rays in the 10–50 keV range at high flux ($10^9$–$10^{16}$ photons/10 ps pulse) can be produced. A time domain representation of a typical X-ray pulse generated by the system 10 is shown in FIG. 4.

Time of Flight Imaging

The fact that the X-rays of this system 10 are pulsed in bursts of a few picoseconds allows them to be used for time-of-flight (TOF) imaging,[14] where data is collected by imaging only ballistic photons up to 180 ps from the initiation of the exposure and ignoring scatter exiting over many nanoseconds. This provides an additional improvement in visibility of 6 to 9 times, and can improve conspicuity of lesions by ten times. In particular, the pulse structure makes gated time-of-flight X-ray imaging for the reduction of scatter in thick targets very simple. With a single X-ray bunch, the system 10 can be used in conjunction with a detector which can be abruptly gated off after the early photons arrive to filter out multiply scattered photons. It is much easier to make a detector which does this (by shorting out the high voltage bias on a microchannel plate, for example) than to make a detector which needs to be gated on an off repeatedly, as would be needed from a system for which more than one bunch of X-rays is needed to make an image.

Phase Contrast Imaging

The small effective spot size of the X-ray beam produced by this system 10 enables the performance of phase contrast imaging using information traditionally discarded in conventional imaging.[15] These improvements in imaging are not restricted to the breast but apply to any body part and to materials science as well. Beams having an energy of approximately 40–50 keV) are achievable using small angles of reflection from mosaic crystal 8 and using higher energy electrons. All of these techniques can be effected while reducing radiation dose to a patient and decreasing scatter due to the tunability of the beam and the limited bandwidth/narrow energy range delivered to the imaged part.

Given the low atomic weights of the major constituents of the human body, there is little difference discernible between body tissues in absorption imaging, due to exceedingly small differences in the very low absorption coefficients of these atoms. However, 100–1000 times as much information can be obtained by using the phase information imparted to the beam as it traverses the patient. Therefore, phase imaging can use a silicon crystal as an analyzer separating X-ray photons diffracted by density changes at tissue interfaces, differences in tissue specific gravity, and even flowing blood, from those photons not diffracted at all. Stepped, slit-scanned images can be acquired at two locations simultaneously on the surface of the same multichannel plate/CCD detector used for the TOF imaging. The part to be imaged can be stepped through the beam and an image acquired for each step. The resultant images are summated into two separate (diffracted and non-diffracted images) and then subtracted from one another for difference phase images.

Figure 2:
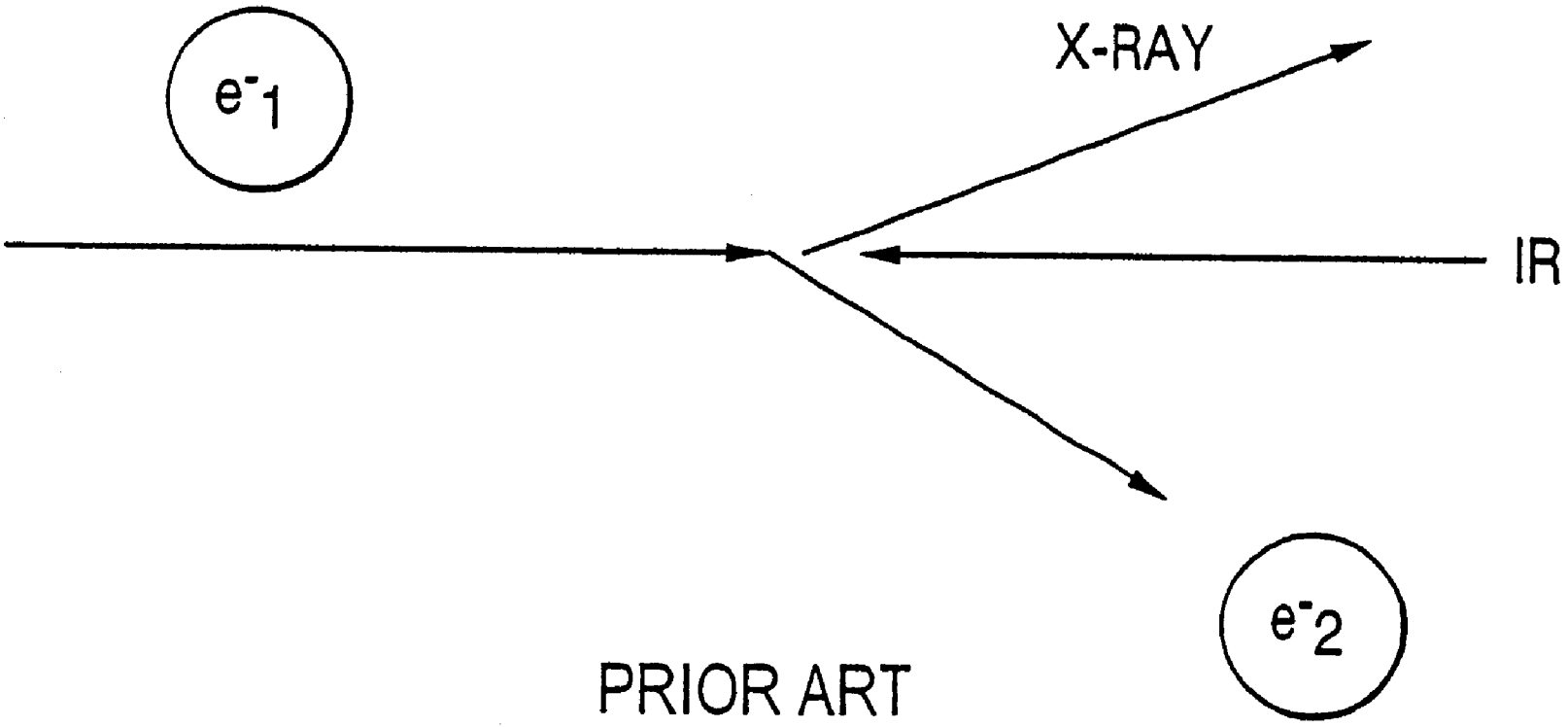
FIG. 2 PRIOR ART
FIG. 2 is a simplified schematic representation of the production of X-ray photons using inverse Compton scattering.

The system 10 of this invention relies on inverse Compton scattering to produce the X-ray photons. The term inverse Compton scattering refers to photon scattering by an electron moving at relativistic speeds. Compton scattering is conventionally known as the process in which a photon scatters off an electron at rest, in which case the photon loses energy to the electron and its wavelength is lengthened. In inverse Compton scattering, the electron is moving and gives up energy to the photon. The basic concept of using inverse Compton scattering to produce X-ray photos is shown in FIG. 2. An incoming electron ($e^1$) from the linear accelerator "collides with" the IR photon, converting it to an X-ray photon which follows a path almost collinear with the electron beam. The relative angles of the post-collision electron beam and X-ray beam are exaggerated on FIG. 2 for clarity.

The inverse Compton scattering of a beam of low energy photons backwards by an anti-parallel beam of electrons can produce a narrow beam of high energy photons. In the case of scattering of the photon through 180°, its energy is increased by several orders of magnitude.

The production rate of X-rays by inverse Compton scattering is governed by two factors: the probability of scattering an infrared photon by an electron, which depends on the cross section, and the intensities of the two beams, which is expressed as the luminosity of the beams.

The first factor is obtained by integrating the differential cross section over the angular range of the narrow cone (~0.005 rad) containing the high energy X-rays. The general solution of the photon-electron scattering yields the Klein-Nishina formulas, which, in the case that the photon energy in the electron rest frame is small compared to that of the electron rest mass, reduce to the Thomson scattering formulas. The electron velocity is relativistic, characterized by $\gamma$=85, where $\gamma$ is the ratio of the electron's energy to its mass.

In a system where the shortest photon wavelengths are about $2\mu$, which correspond to an energy in the labaratory rest system of 0.52 eV, the photon energy in the electron rest system is small compared to $m_e c^2$ of 0.511 MeV. The total Thomson cross section is given by $$\sigma_T = \frac{8\pi}{3} r_e^2,$$

where $r_e$ is the classical electron radius.

Due to the relativistic electron motion, which has a Lorentz factor $\gamma = E_e/m_e c^2$, the scattering angle in the electron rest frame is related to the half-angle of the X-ray cone in the laboratory frame by $\Theta_s = 2\gamma\theta_c$.

The cross section for scattering into the forward cone is $$\int_{\pi}^{\pi-\Theta_S} \pi r_e^2 (1 + \cos^2\Theta_S)\sin\Theta_S \, d\Theta_S$$

For a half-angle of 0.005 rad, the cross-section is 0.21 of the total Thomson cross section of 0.66 barn ($=6.6\times10^{-29}m^2$). As seen by the electron, the photon energy is increased by a factor of $2\gamma$ to ~102 eV. This energy is so small compared to the electron rest mass that the Compton shift of wavelength is negligible. The photon is scattered nearly elastically through some angle $\Theta_3$. Near $\Theta_3$=180° the energy of the scattered photon as seen in the laboratory system gains another factor of $2\gamma$, reaching a maximum of ~17.9 keV.

The second factor is the luminosity, which for colliding beams is $$L = N_e \times N_\gamma \times f / A,$$

where $N_e$ is the number of electrons per micropulse, $N_\gamma$ is the number of photons per micropulse, f the frequency of micropulses, and A the area of overlap of the two beams. The area can be calculated by integrating the product of the Gaussian distribution of the particles. If the two beams have the same size, the area is related to the width of the beams by $A = \pi(2\sigma)^2$. For different radii, the area is $A = \frac{1}{2}\pi(r_e^2 + r_\gamma^2)$.

In a preferred embodiment of the system 10, the two beams are brought into co-alignment by an alignment tool 20 as shown in FIG. 3, first by visualization of the transition radiation produced by the electron beam hitting a beryllium screen 21 and secondly by focusing the IR laser beam onto an aluminum screen 22. Both beams are observed through a common CaF window via a CCD TV camera with a remotely controlled and adjustable zoom/focus/iris lens. The alignment screen 23 assures centering of the device within the vacuum beamline pipe. Next the electron viewing screen 21 is used to delineate the location, size and shape of the electron beam from the transition radiation generated by the beam striking the screen. Lastly, the IR viewing screen 22 is used to steer the pointing lasers to the center of the electron beam.

An X-ray detector consisting of two thin silicon surface-barrier detectors (not shown) can be used with the system 10. The detector is placed outside of the beamline on the optical table adjacent to a 0.010 inch beryllium window used as an exit port for the X-ray beam. These detectors are used as calorimeters, which are separated by an aluminum absorber. The front detector sees both the intense high energy background radiation, plus the low energy X-rays produced by the inverse Compton scattering. The rear detector sees only the high energy background. Subtraction of one signal from the other using a balanced differential amplifier chain allowed for the separation of the signals and display of the X-ray signal as a time-resolved voltage overlying the timing signals generated by the electron beam and IR beam pulses. In one embodiment, there are approximately $10^{10}$ photons/pulse.

In one of the objects of the invention, the wavelength of the X-ray pulse generated by the system 10 can be tuned by changing the energy level of the electrons emitted by the RF LINAC 3, by adjusting the RF source.

The monochromaticity and narrow divergence angle of the X-ray beam produced by this system 10 not only enables the mosaic crystals to divert the beam to an imaging laboratory or patient treatment room, but also allows the redirection of the beam in a circular fashion creating CT images using conebeam backprojection algorithms.

The time structure and the tunability make the system 10 attractive to the scientific community for exceedingly fast time-resolved studies of electronic, chemical and mechanical processes. The X-rays are not produced in a continuous spectrum, but are of very narrow bandwidth significantly reducing radiation dose to patients (from 2 to 50 times depending on the procedure being performed), Due to the small effective focal spot size, they can be used in phase contrast imaging, which delivers 100 to 1000 times the information than that obtained by the use of absorption imaging alone (the information used by radiologists for the last 100 years). The beam geometry is one of an area large enough to study large body parts, rather than the limited area visible at synchrotron facilities. The system is small enough to fit into a standard X-ray room and can be built to service several rooms at a time, reducing the amount of equipment needed by any radiology department.

Harmonic Generation

In another embodiment, the system 10 of this invention is also advantageous in its generation of harmonics. Referring again to FIG. 1, when the intensity of laser 1 is high enough, the number of X-ray photons generated on the second, third, and higher harmonics can become comparable to or greater than the number of photons on the fundamental. Increasing the beam intensity and/or decreasing the beam spot size at the IZ can affect the generation of harmonics to obtain a set of discrete monochromatic X-ray pulses at different energy levels. For example, for a 10 Joule pump laser pulse in 1 ps, focused to a 20-micron diameter, the number of photons on the harmonics exceeds the number at the fundamental. The X-ray photons at the harmonics propagate in substantially the same direction as the fundamental. If the output of the laser 1 is operated to generate a pulse of 10 Joules in a 20 ps pulse, focused to a beam diameter of 50 microns, the number of X-ray photons on the second harmonic are approximately one percent of the number of X-ray photons on the fundamental.

The presence of harmonics in the output of system offer several possible advantages, including:

(1) Lower electron energy. For example, for 20-keV X-rays, operating on the fundamental requires the presence of 33-MeV electrons. However, operating on the third harmonic requires only 19-MeV electrons. This reduces the LINAC requirements and, in particular, the radiation shielding requirements. The desired harmonic could be selected at the output of the system by using a combination of conventional absorption filters and crystal reflectors (not shown).

(2) Multiple wavelengths present in the harmonics could be used to produce images at several discrete wavelengths for image processing.

(3) Multipass operation. After the laser beam has intersected the electron beam, it can be reflected with mirrors to intersect subsequent electron micropulses. These might be spaced at any subharmonic of the RF frequency of the accelerator, though several-nanosecond intervals would probably be most convenient. Multiple electron pulses could be formed by splitting the cathode drive laser pulse and delaying some pulses or by switching out several pulses from the mode-locked oscillator/amplifier system. One pump laser pulse could be used several times, perhaps 10 times or more. Although the laser would intersect the electron beam from different directions, the X-rays would all propagate in the direction of the electron beam axis. Multipass operation would increase the total number of x-rays produced from a single laser pulse. Also, subsequent passes might be aligned at different angles to change the energy (but not the direction) of the x-rays. This might be useful for image processing, or might be used in scientific experiments to excite or probe a sample at different wavelengths at different times. The change in wavelengths could be used to separate successive x-ray pulses after they pass through the sample. Subsequent passes could be aligned to change the polarization of the x-rays. It is a unique feature of the Compton x-ray system that the x-rays are linearly polarized (or circularly polarized if the pump laser is circularly polarized). The change in polarization might have advantages for probing the system, improving images, or separating successive pulses.

Multiple Pulse Mode

In yet another embodiment, the system 10 is capable of producing two or more pulses in either closely spaced (picoseconds) or widely spaced (nanoseconds) groups. Optionally, pairs or groups of pulses can be generated to produce different X-ray energies. The system 10 can be operated in a closely-spaced, multiple pulse mode by splitting and re-combining the output of the laser 1 with a small time offset, resulting in the amplification of a pulse-pair. If this pulse pair is applied to the photocathode 2 and amplified into the interaction zone IZ, it can result in pairs of X-ray pulses separated by a few picoseconds to a few tens of picoseconds being generated. By taking advantage of the dependence of the electron beam energy on the phase of the electron bunch relative to the main radio-frequency (RF) drive of the system, one could generate electron pulses of different energies which would result in X-ray pulses of different energies being produced.

To produce widely spaced pulse groups, system 10 will be capable of producing trains of pulses separated by multiples of the basic RF period (about 340 ps in the preferred embodiment), with a resultant large increase in X-ray production within a few nanosecond burst. This mode would be useful for many applications in which the extremely fast picosecond time structure is irrelevant, and for which generating a maximum number of X-rays within a few nanosecond window is desired. This can be achieved by first splitting the output pulse from laser I and recombining part of it into a pulse train to be fed to the photocathode 2 drive amplifier to produce a train of electron bunches separated by a multiple of the RF period. Then, the main laser pulse which is passed through the interaction zone IZ would be re-collected after each pass through, brought back and refocused into the IZ and re-collided with the next pulse in the electron bunch train. This would allow the system 10 to recycle the photons from the main drive laser 1 quite a few times to produce many more X-rays (possibly more than 10 times as many) in a nanosecond burst. Further, using appropriate gated detectors with this embodiment of the system 10, freeze-frame X-ray movies of processes on the nanosecond time scale could be obtained.

Generation of Multiple X-ray Beams

Figure 5:
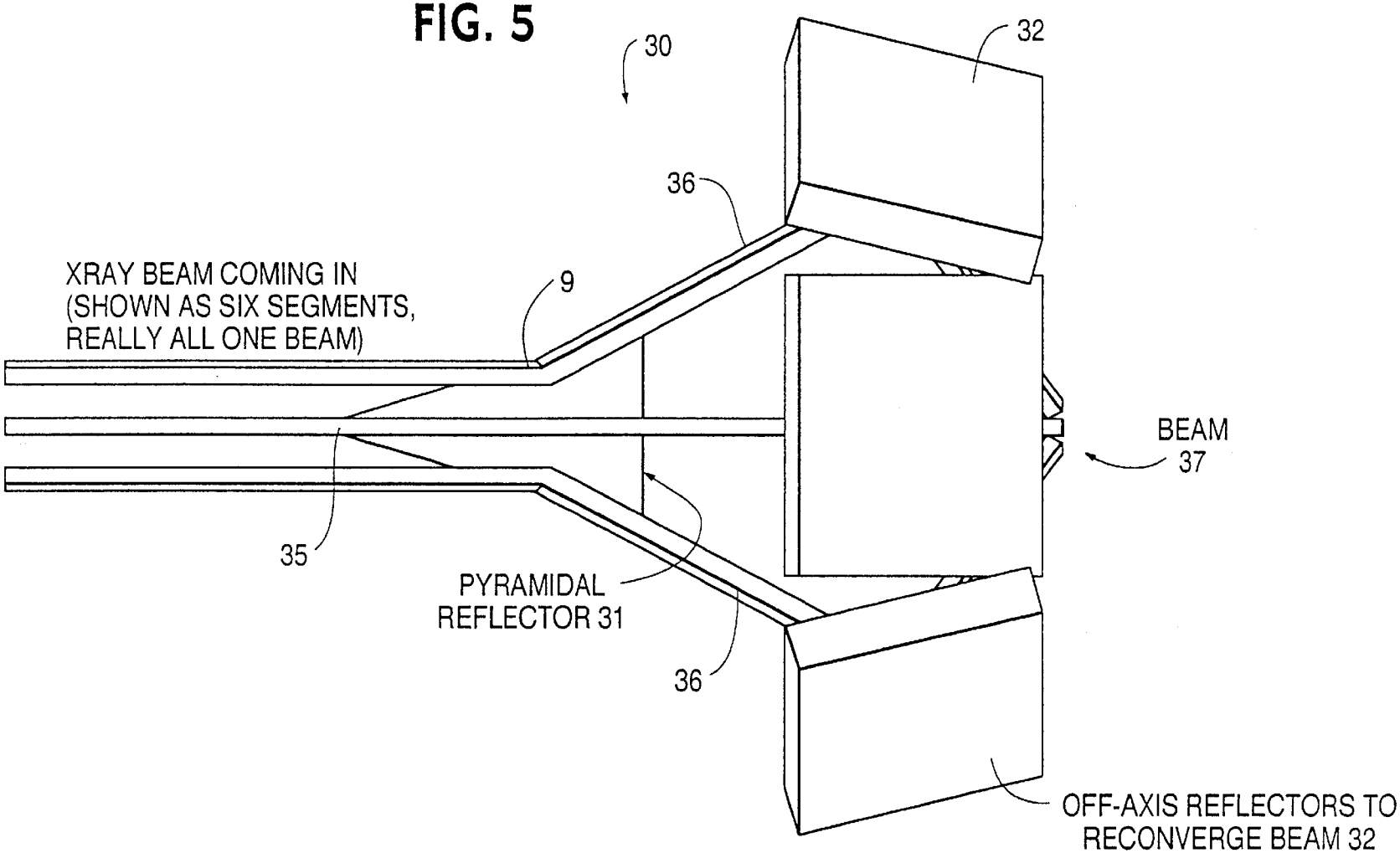
FIG. 5 is a side view of an apparatus for producing multiple X-ray beams from a single X-ray pulse generated by the system of FIG. 1.
Figure 6:
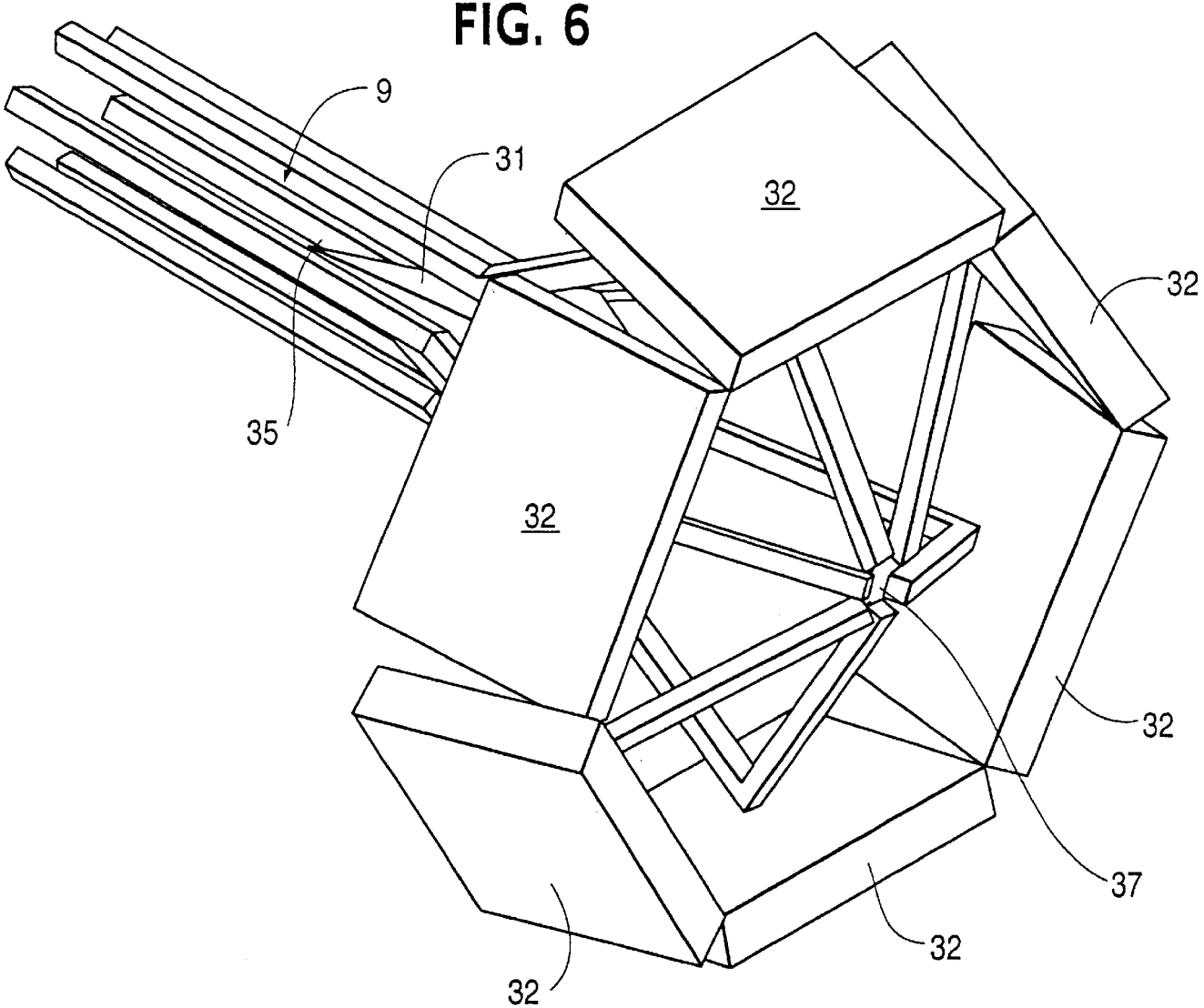
FIG. 6 is a perspective view of the apparatus of FIG. 5.

The system 10 can be used to generate multiple X-ray beams so that a single pulse will produce multiple images that would be needed, for example, for CT reconstruction. A beam reflection apparatus 30 for production of multiple beams from a single X-ray beam 9 from system 10 is shown on FIGS. 5 and 6. The incoming beam 9 is directed to a multi-faceted pyramidal X-ray mirror 31 (made of either graphite crystal or a multilayer metal) having its apex 35 facing the beam 9. The mirror 31 splits the incoming beam 9 into a set of beams 36 that diverge at a small angle toward a corresponding set of off-axis reflectors 32. The split beams are then re-directed at 37 back to the axis of the incoming beam 9 while crossing the original axis at different angles.

Energy Scaling

The system 10 as described can easily be scaled to produce X-rays of higher energy, while preserving the high fluxes available in the preferred embodiment. Since the energy of the emitted X-rays increases as the square of the electron beam energy (for X-ray energies much less than the electron-beam energy, i.e., less than many MeV), lengthening the LINAC will provide X-rays easily beyond the energy range used for the highest energy materials science work (a few hundred keV) and even into the gamma ray region (a few MeV) with very high fluxes. The embodiment of FIG. 1 uses a LINAC 3 approximately 2 meters long, and should be able to provide X-rays beyond 60 keV. Using a 4 meter long LINAC 3, this would generate up to four times this energy, or 240 keV. Such an embodiment would result in a system 10 that is physically larger, and therefore would not be preferred for compact medical devices, but could be of benefit in materials radiography.

Thus, although there have been described particular embodiments of the present invention it is not intended that such references be construed as limitations upon the scope of this invention except as set forth in the following claims. The disclosure of the following references are incorporated herein:

1. U.S. Pat. No. 4,598,415. A. U. Luccio, B. A. Brill. "Method and apparatus for producing X-rays." Dated Jul. 1, 1986. U.S. Patent Office.
2. F. E. Carroll, J. W. Waters, R. R. Price, C. A. Brau, C. F. Roos, N. H. Tolk, D. R. Pickens, and W. H. Stephens. "Near-monochromatic X-ray beams produced by the free-electron laser and Compton backscatter," Invest Radiol. 25: pp. 465–471, 1990.
3. C. A. Brau, "The Vanderbilt university free-electron center," *Nucl. Instrum. & Methods* A 319, p.47, 1992.

4. C. A. Brau and M. H. Mendenhall, "The Vanderbilt university free-electron center", *Nucl. Instrum. & Methods* A 331, p.4, 1993.
5. C. A. Brau and M. H. Mendenhall, "Medical and materials research at the Vanderbilt university free-electron center," *Nucl. Instrum. & Methods* A 341, p.21, 1993.
6. J. M. Madey, "Stimulated emission of bremsstrahlung in a periodic magnetic field." *J. Appl. Phys.* 42: pp. 1906–1913, 1971.
7. W. Dong, C. A. Brau, J. W. Waters, P. A. Tompkins, F. E. Carroll, R. R. Price, D. R. Pickens, and C. F. Roos, "Current status of the VU MFEL Compton X-ray program" *Journal of X-ray Science and Technology* 4, pp. 346–352, 1994.
8. F. Amirmahdi, C. Brau, M. Mendenhall, J. R. Engholm, and U.

Happek, "Electron bunch length measurements at the Vanderbilt FEL", *Nucl. Instrum & Methods* A 375, p 427, 1996.

9. D. L. Burke, et al, "Positron production in multi-photon light-by-light scattering." *Phys. Rev. Lett.* 79: pp. 1626–1629, 1997.
10. P.C. Johns, M. J. Yaffe. "X-ray characterization of normal and neoplastic breast tissues." *Phys Med Biol* 32: pp. 675–695, 1987.
11. F. E. Carroll, J. W. Waters, W. W. Andrews, R. R. Price, D. R. Pickens, R. Willcott, P. Tompkins, C. Roos, D. Page, G. Reed, A. Ueda, R. Bain, P. Wang, and M. Bassinger. "Attenuation of monochromatic X-rays by normal and abnormal breast tissues." *Invest Radiol.* 29: pp. 266–272, 1994.
12. C. J. Sparks. "Mosaic crystals for obtaining larger energy bands and high intensities from synchrotron radiation sources." *SSRL Report No.* 78/04, May 1978.
13. P. A. Tompkins. "Application of graphite mosaic monochromator crystals for X-ray transport." *Journal of X-ray Science and Technology.* 4: pp. 301–311, 1994.
14. C. L. Gordon, Y. Yin, B. E. Lemoff, P. M. Bell, and C.P.N. Barty. "Time-gated imaging with an ultrashort pulse, laser-produced plasma X-ray source." *Optics Letters.* Vol 20, No.9: pp. 1056–1058, May 1995.
15. T. Takeda, A. Momose, Y. Itai, J. Wu, and K. Hirano. "Phase-contrast imaging with synchrotron X-rays for detecting cancer lesions. Preliminary investigation." *Acad Radiol* 2: pp. 799–803, 1995.

See, also, D. L. Burke et al, Physical Review Letters Vol. 79, p. 1626–1629 (1997).

What is claimed is:

1. A system for generating X-rays, comprising:

an electron beam source for directing a pulse of electrons having a pre-determined electron pulse length at a beam collision point in a beam interaction zone; and a laser beam source for directing an optical pulse of photons at the beam collision point, wherein the electrons in the electron pulse collide with the photons in the optical pulse at the beam collision point, the collision thereby converting at least some of the photons into a single pulse of approximately monochromatic X-ray photons, and further wherein pulse characteristics of the single X-ray pulse are independently configured relative to another pulse produced by the system.

2. The system of claim 1 wherein the single X-ray pulse has an X-ray energy within a range of approximately 10–50 keV and an X-ray pulse length approximately 10 ps or less.

3. The system of claim 2 wherein electron beam source and laser beam source are operative to generate the X-ray pulse at a flux density of >approxitmately $10^6$ to $10^{16}$ photons/pulse.

4. The system of claim 3 wherein the electron beam and laser beam each have a respective spot size at the beam collision point selected to produce an X-ray beam spot size diameter approximately in the range of 25–100 microns.

5. The system of claim 2 wherein the electron pulse length is less than 10 ps.

6. The system of claim 5 wherein the electron pulse charge is equal to or greater than one nanocoulomb.

7. The system of claim 1 wherein the laser beam source comprises a tabletop laser.

8. The system of claim 1 wherein the laser beam source comprises a chirped pulse amplifier terawatt laser.

9. The system of claim 6 wherein the optical pulse has an energy level of approximately 10 Joules and pulse length of approximately 10 ps.

10. The system of claim 1, further comprising a synchronization means to synchronize the electron beam source and the laser beam source such that the electrons in the electron pulse collide with the photons in the optical pulse at the beam collision point, wherein the synchronization means comprises a synchronization beam generated by the laser beam source, the synchronization beam transmitted concurrently with the laser beam and transmitted to the electron beam source to thereby trigger simultaneous generation of the electron pulse.

11. The system of claim 1 further comprising a beam alignment tool operatively coupled to the interaction zone.

12. The system of claim 11, wherein the beam alignment tool allows spatial alignment of the electron pulse and the optical pulse at the beam collision point, and further wherein the beam collision point is contained within a beam pipe, the beam alignment tool comprising:

an alignment screen which centers the beam alignment tool within the beam pipe;

an electron viewing screen which visually displays transition radiation produced by electrons in an electron beam striking the electron viewing screen; and an IR viewing screen which visually displays light from a beam produced by a pointing laser that represents the single optical pulse of photons from the laser source, wherein the location of the electron beam is first marked at the center of the alignment screen, and further wherein the location of the pointing laser beam is thereafter steered to the same location as the electron beam.

13. The system of claim 1, wherein the X-ray pulse is used to image a target object.

14. A method of generating X-rays comprising:

generating a single optical pulse at a predetermined energy level and pulse length;

generating a single electron pulse at a predetermined pulse length, synchronously with generation of the optical pulse; and directing the optical pulse and the electron pulse at a collision point in a beam interaction zone whereby a collision of electrons in the electron pulse with photons in the optical pulse will generate a single pulse of monochromatic X-rays.

15. The method of claim 14 wherein the optical pulse is generated by a tabletop laser and the electron pulse is synchronized with the optical pulse by using a laser beam from the laser to trigger generation of the electron pulse.

16. The method of claim 14, wherein said directing the optical pulse and the electron pulse at a collision point in a beam interaction zone further comprises:

placing a beam alignment tool within a beam pipe, in a vicinity of the beam collision point;

centering the beam alignment tool within the beam pipe using an aliment screen observing a location on an electron viewing screen of transition radiation produced by electrons in an electron beam striking the electron viewing screen:

observing light from a beam produced by a pointing laser that represents the single optical pulse of photons from the laser source on an IR viewing screen; and steering the pointing laser light to the observed location of the electron viewing screen.

17. The method of claim 14 wherein the X-ray pulse has a pulse length in the range of approximately 2–10 ps.

18. The method of claim 14, wherein said directing the optical pulse and the electron pulse at a collision point in a beam interaction zone further comprises focusing the optical pulse and the electron pulse such that a spot size diameter of the X-ray pulse is approximately in the range of 25–100 microns.

19. The method of claim 13 further comprising imaging a target object using the X-ray pulse, including adjusting the wavelength of the X-ray pulse in accordance with X-ray imaging characteristics of the target object.

20. The method of claim 14 further comprising adjusting an energy level of the X-ray pulse.

21. A system for generating multiple X-ray images of a target object comprising:

a. an electron beam source for directing a pulse of electrons having a pre-determined electron pulse length at a beam collision point in a beam interaction zone;

b. a laser beam source for directing a single optical pulse of photons at the beam collision point;

c. synchronization means to synchronize the electron beam source and the laser beam source such that the electrons in the electron pulse collide with the photons in the optical pulse at the beam collision point, the collision thereby converting at least some of the photons into a single primary X-ray pulse of monochromatic X-ray photons, the single primary X-ray pulse having an X-ray pulse length substantially comparable to the electron pulse length; and d. means to direct the primary X-ray pulse along a beam path from the beam interaction zone to the apex of an X-ray mirror, the X-ray mirror having multiple facets operable to split the primary X-ray pulse into multiple diverging secondary X-ray pulse; and e. multiple X-ray reflectors arranged to receive the secondary X-ray pulses and re-converge the secondary X-ray pulses at different angles toward the beam path of the primary X-ray pulse.

22. A system for generating X-rays for performing an application, comprising:

an electron beam source which directs a single pulse of electrons at a beam collision point in a beam interaction zone; and a laser beam source which directs a single optical pulse of photons at the beam collision point, wherein the single pulse of electrons and the single optical pulse of photons interact to produce a single pulse of X-ray photons, and further wherein the single pulse of X-ray photons is the only pulse of X-ray photons used to perform the application.

23. The system of claim 22, further comprising:

a detector that detects at least a portion of the single pulse of X-ray photons, and further wherein the application is an imaging of a target object based on the detected portion of the single pulse of X-ray photons.

24. A system for generating X-rays for forming an image of a target object, comprising:

an electron beam source which directs only a single pulse of electrons at a beam collision point in a beam interaction zone;

a laser beam source which directs only a single optical pulse of photons at the beam collision point; and a detector which detects at least a portion of only a single pulse of X-ray photons that is produced by a collision between the single pulse of electrons and the single optical pulse of photons at the beam collision point.

25. The system of claim 24, wherein at least a portion of the single pulse of X-ray photons is transmitted through the target object before reaching the detector, and further wherein the image is obtained from the transmitted portion of the single pulse of X-ray photons.

26. A method for generating X-rays, comprising:

generating only a single optical pulse of photons directed towards a beam collision point;

generating only a single pulse of electrons directed towards the beam collision point; and colliding the single optical pulse of photons and the single pulse of electrons at the beam collision point to produce only a single pulse of X-rays.

27. The method of claim 26, further comprising:

directing the single pulse of X-rays towards a target object; and imaging the target object based on the single pulse of X-rays.

28. A method of imaging a target object, comprising:

generating a single optical pulse of photons directed towards a beam collision point;

generating a single pulse of electrons directed towards the beam collision point;

colliding the single optical pulse of photons and the single pulse of electrons at the beam collision point to produce a single pulse of X-rays;

directing the single pulse of X-rays towards the target object; and imaging the target object based on the single pulse of X-rays, wherein the single pulse of X-rays is the only pulse of X-rays used to image the object.

* * * * *

UNITED STATES PATENT AND TRADEMARK OFFICE

CERTIFICATE OF CORRECTION

PATENT NO. : 6,332,017 B1
DATED : December 18, 2001
INVENTOR(S) : Frank E. Carroll et al.

It is certified that error appears in the above-identified patent and that said Letters Patent is hereby corrected as shown below:

Title page,

After Item [22], add Related U.S. Application Data as follows:

-- Related U.S. Application Data

[60] Provisional Application No. 60/117,114, filed on Jan. 25, 1999. --

Signed and Sealed this

Twenty-eighth Day of October, 2003

JAMES E. ROGAN

*Director of the United States Patent and Trademark Office*